US011702902B2

(12) United States Patent
Pujol et al.

(10) Patent No.: US 11,702,902 B2
(45) Date of Patent: Jul. 18, 2023

(54) SYSTEM AND METHOD FOR ACTUATING A LOCKING ASSEMBLY

(71) Applicant: Schlumberger Technology Corporation, Sugar Land, TX (US)

(72) Inventors: Jean-Luc Pujol, Beziers (FR); Sebastien Poveda, Beziers (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/154,187

(22) Filed: Jan. 21, 2021

(65) Prior Publication Data

US 2022/0228455 A1 Jul. 21, 2022

(51) Int. Cl.
*E21B 33/06* (2006.01)
*F15B 15/26* (2006.01)

(52) U.S. Cl.
CPC ..... *E21B 33/062* (2013.01); *F15B 15/261* (2013.01)

(58) Field of Classification Search
CPC ..... E21B 33/06; E21B 33/062; E21B 33/064; F15B 15/261; F16K 35/02
See application file for complete search history.

(56) References Cited

U.S. PATENT DOCUMENTS 3,941,141 A 3/1976 Robert
8,978,699 B2 * 3/2015 Jaffrey ..... E21B 33/061 137/553
9,863,206 B2 * 1/2018 Biester ..... E21B 47/12
2008/0048140 A1 * 2/2008 Whitby ..... E21B 33/062 251/1.3
2008/0099701 A1 5/2008 Whitby
2013/0264503 A1 10/2013 Jahnke
2014/0033842 A1 2/2014 Morin
2015/0152705 A1 6/2015 Jaffrey
2016/0131251 A1 5/2016 Paisley
(Continued)

FOREIGN PATENT DOCUMENTS

JP 107676067 B * 7/2019 ..... E21B 43/16
WO WO2009060707 A1 * 3/2011
WO WO-2020169714 A1 * 8/2020 ..... E21B 33/062

OTHER PUBLICATIONS

Search Report and Written Opinion of International Patent Application No. PCT/EP2020/054442 dated May 7, 2020; 14 pages.
(Continued)

*Primary Examiner* — Aaron L Lembo
(74) *Attorney, Agent, or Firm* — Kelly McKinney

(57) ABSTRACT

A locking assembly includes a first motor gear configured to be rotated in a first direction. The locking assembly also includes a second motor gear configured to be rotated in a second direction. The locking assembly also includes a first lock gear configured to be rotated in the first direction in response to the first motor gear rotating in the first direction. The locking assembly also includes a second lock gear configured to be rotated in the second direction in response to the second motor gear rotating in the second direction. The locking assembly also includes a locking mechanism configured to be rotated in the first direction in response to the first lock gear rotating in the first direction, and to be rotated in the second direction in response to the second lock gear rotating in the second direction.

19 Claims, 10 Drawing Sheets

(56) References Cited

U.S. PATENT DOCUMENTS

| | | | |
|---|---|---|---|
| 2016/0201423 | A1 | 7/2016 | Biester et al. |
| 2022/0136356 | A1 | 5/2022 | Poveda et al. |

OTHER PUBLICATIONS

International Preliminary Report on Patentability of International Patent Application No. PCT/EP2020/054442; 9 pages.
Exam Report under section 18(3) issued in United Kingdom Patent Application No. GB2111523.3 dated May 16, 2022, 2 pages.
Exam Report under section 18(3) issued in United Kingdom Patent Application No. GB2111523.3 dated Jan. 19, 2023, 3 pages.

* cited by examiner

SYSTEM AND METHOD FOR ACTUATING A LOCKING ASSEMBLY

BACKGROUND

A blowout preventer (BOP) stack is installed on a wellhead to seal and control a wellbore during drilling operations. A drill string may be suspended from a rig through the BOP stack into the wellbore. During drilling operations, a drilling fluid is delivered through the drill string and returned up through an annulus between the drill string and a casing that lines the wellbore. In the event of a rapid invasion of formation fluid in the annulus, commonly known as a "kick," a movable component within the BOP stack may be actuated to seal the annulus and to control fluid pressure in the wellbore, thereby protecting well equipment above the BOP stack.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A locking assembly is disclosed. The locking assembly includes a first motor gear configured to be rotated in a first direction in response to a motor shaft rotating in the first direction. The locking assembly also includes a second motor gear configured to be rotated in a second direction in response to the motor shaft rotating in the second direction. The motor shaft rotates in the first direction and the second direction at substantially a same pressure. The locking assembly also includes a first lock gear configured to be rotated in the first direction in response to the first motor gear rotating in the first direction. The locking assembly also includes a second lock gear configured to be rotated in the second direction in response to the second motor gear rotating in the second direction. The locking assembly also includes a locking mechanism configured to be rotated in the first direction in response to the first lock gear rotating in the first direction, and to be rotated in the second direction in response to the second lock gear rotating in the second direction.

A system is also disclosed. The system includes a motor having a motor shaft that is configured to rotate in a first direction in response to a first motor pressure, and to rotate in a second direction in response to a second motor pressure. The first and second directions are opposite to one another, and the first and second motor pressures are within 1 MPa of one another. The system also includes a locking assembly. The locking assembly includes a smaller motor gear configured to be rotated in the first direction in response to the motor shaft rotating in the first direction. The locking assembly also includes a larger motor gear configured to be rotated in the second direction in response to the motor shaft rotating in the second direction. The locking assembly also includes a larger lock gear configured to be rotated in the first direction in response to the smaller motor gear rotating in the first direction. The locking assembly also includes a smaller lock gear configured to be rotated in the second direction in response to the larger motor gear rotating in the second direction. The locking assembly also includes a first belt wrapped at least partially around the smaller motor gear and the larger lock gear. The first belt is configured to transmit torque from the smaller motor gear to the larger lock gear. The locking assembly also includes a second belt wrapped at least partially around the larger motor gear and the smaller lock gear. The second belt is configured to transmit torque from the larger motor gear to the smaller lock gear. The locking assembly also includes a locking mechanism configured to be rotated in the first direction in response to the larger lock gear rotating in the first direction, which causes the locking mechanism to move in a first axial direction and to actuate from an unlocked configuration to a locked configuration. The locking mechanism is configured to be rotated in the second direction in response to the smaller lock gear rotating in the second direction, which causes the locking mechanism to move in a second axial direction and to actuate from the locked configuration to the unlocked configuration. The system also includes a blowout preventer (BOP) configured to actuate between an open configuration and a closed configuration. The locking mechanism allows the BOP to actuate between the open configuration and the closed configuration when the locking mechanism is in the unlocked configuration. The locking mechanism prevents the BOP from actuating between the open configuration and the closed configuration when the locking mechanism is in the locked configuration.

A method for operating a blowout preventer (BOP) is also disclosed. The method includes actuating the BOP from an open configuration into a closed configuration. The method also includes actuating a locking assembly from an unlocked configuration into a locked configuration when the BOP is in the closed configuration. Actuating the locking assembly from the unlocked configuration into the locked configuration includes causing a motor shaft to rotate in a first direction, which causes a first motor gear to rotate in the first direction, which causes a first lock gear to rotate in the first direction, which causes a locking mechanism to rotate in the first direction, which causes the locking mechanism to move in a first axial direction, which actuates the locking assembly from the unlocked configuration into the locked configuration. The locking assembly prevents the BOP from actuating between the open configuration and the closed configuration when the locking assembly is in the locked configuration.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
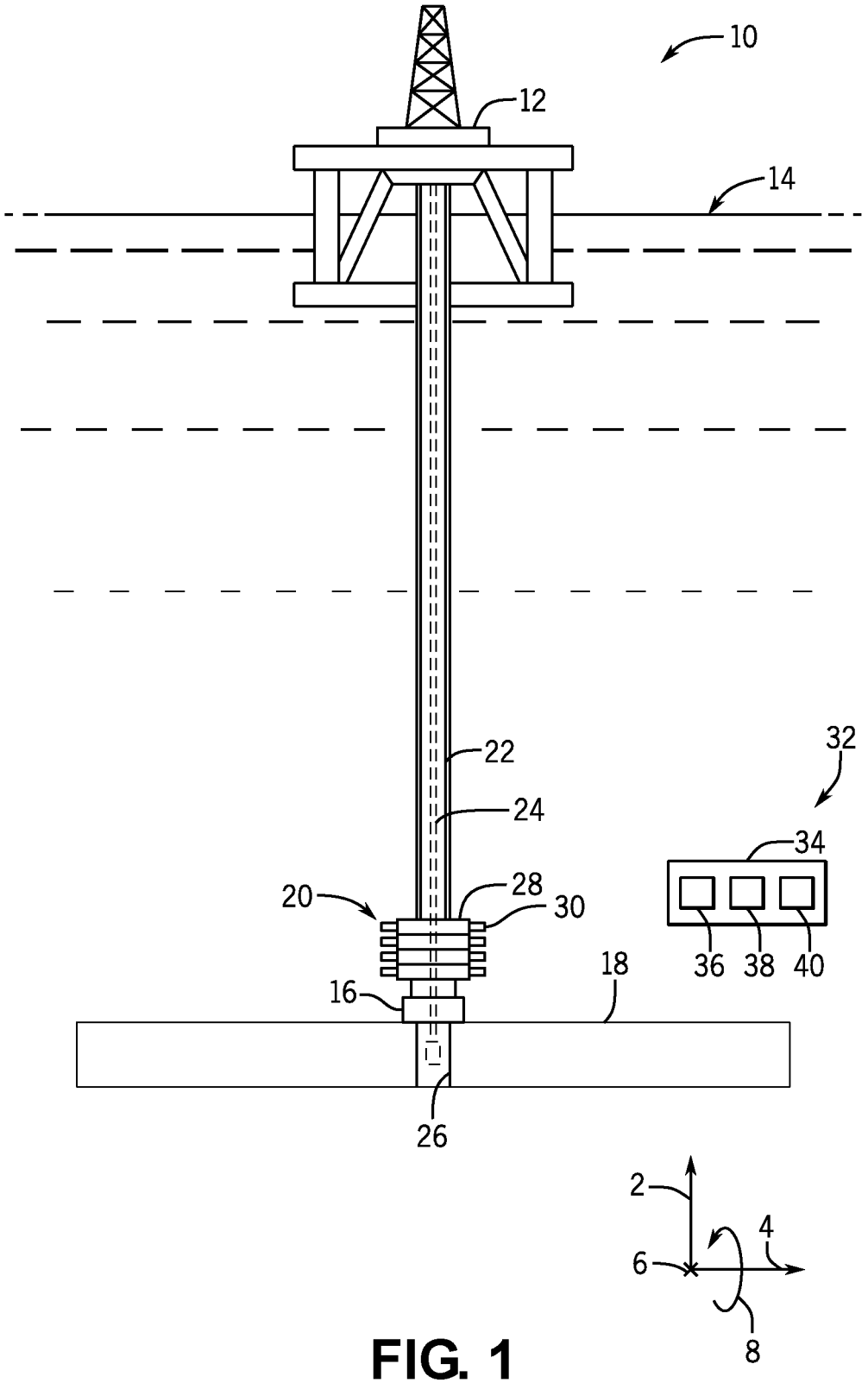
FIG. 1 illustrates a schematic diagram of an offshore system that has a blowout preventer (BOP) and a remote locking system, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

The present disclosure is generally directed to blowout preventers (BOPs). In particular, the present disclosure is generally directed to a remote locking system for a BOP and/or a method for remote locking of a locking mechanism (e.g., lock screw) for the BOP. The remote locking system may be configured to actuate between a first (e.g., unlocked) configuration and a second (e.g., locked) configuration. In the unlocked configuration, the remote locking system allows movement of rams of the BOP. In the locked configuration, the remote locking system prevents movement of the rams of the BOP.

While certain embodiments disclosed herein relate to an offshore system (e.g., subsea system), it should be understood that the BOP and the remote locking system may be used in an on-shore system (e.g., land-based system). Furthermore, while certain embodiments disclosed herein relate to a drilling system that may be used to carry out drilling operations, it should be appreciated that the BOP and the remote locking system may be adapted for use in any of a variety of contexts and during any of a variety of operations. For example, the BOP and the remote locking system may be used in a production system and/or in a pressure control equipment (PCE) stack that is positioned vertically above a wellhead during various intervention operations (e.g., inspection or service operations), such as wireline operations in which a tool supported on a wireline is lowered through the PCE stack to enable inspection and/or maintenance of a well. In such cases, the BOP may be adjusted from the open configuration to the closed configuration (e.g., to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

FIG. 1 illustrates a schematic view of an offshore system 10 (e.g., offshore drilling system), according to an embodiment. The offshore system 10 and its components may be described with reference to a vertical axis or direction 2, an axial axis or direction 4, a lateral axis or direction 6, and a circumferential axis or direction 8. The offshore system 10 includes a vessel or platform 12 at a sea surface 14, and a wellhead 16 positioned at a sea floor 18. The offshore system 10 also includes a BOP stack 20 positioned above the wellhead 16, and a riser 22 that extends between the BOP stack 20 and the vessel or platform 12. Downhole operations may be carried out by a conduit 24 that extends from the vessel or platform 12, through the riser 22, through the BOP stack 20, through the wellhead 16, and into a wellbore 26.

The BOP stack 20 may include one or more BOPs (four are shown: 28) stacked along the vertical axis 2 relative to one another. As described in greater detail below, one or more of the BOPs 28 may include opposed rams that are configured to move along the axial axis 4 toward and away from one another to adjust the BOP 28 between a first (e.g., open) configuration and a second (e.g., closed) configuration. In the open configuration, the opposed rams may be retracted (e.g., withdrawn) from a central bore of the BOP 28, and thus, the BOP 28 may enable fluid flow through the central bore. In the closed configuration, the opposed rams may be extended into (e.g., positioned in) the central bore of the BOP 28, and thus, the BOP 28 may block fluid flow through the central bore.

The BOP stack 20 may include any of a variety of different types of BOPs 28 (e.g., having shear rams, blind rams, blind shear rams, pipe rams). For example, in one embodiment, the BOP stack 20 may include one or more BOPs 28 having opposed shear rams or blades configured to sever the conduit 24 to block fluid flow through the central bore. In another embodiment, the BOP stack 20 may include one or more BOPs 28 having opposed pipe rams configured to engage the conduit 24 to block fluid flow through the central bore (e.g., through an annulus about the conduit 24).

As shown, the BOP stack 20 may include one or more remote locking assemblies 30. For example, one remote locking assembly 30 may be positioned at each end (e.g., along the axial axis 4) of the BOP 28. The remote locking assembly 30 may be part of a remote locking system 32 that operates to adjust components of the remote locking assembly 30 between a first (e.g., unlocked) configuration and a second (e.g., locked) configuration. In the unlocked configuration, the remote locking assembly 30 allows movement of the rams of the BOP 28. In the locked configuration, the remote locking assembly 30 prevents movement of the rams of the BOP 28.

The remote locking assembly 30 may be in the locked configuration to maintain the BOP 28 in the open configuration, the closed configuration, and/or the position therebetween. However, the remote locking assembly 30 may be actuated to the unlocked configuration to allow the rams of the BOP 28 to move relative to the central bore between the open configuration and the closed configuration. For example, in response to an indication of an increased pressure within the wellbore 26 or another indication (e.g., operator input or test cycle) that the rams of the BOP 28 should be moved from the open configuration to the closed configuration, the rams of the BOP 28 may be moved from the open configuration to the closed configuration, and the remote locking system 32 may operate to actuate the remote locking assembly 30 from the unlocked configuration to the locked configuration to maintain the rams of the BOP in the closed configuration, thereby facilitating maintenance of a seal across the central bore of the BOP 28.

The remote locking system 32 may include a controller 34 (e.g., electronic controller) having a processor 36 and a memory device 38. In some embodiments, the processor 36 may receive and process signals from a sensor that monitors the pressure within the wellbore 26 to determine that the BOP 28 should be adjusted from the open configuration to the closed configuration (or vice versa). In some embodiments, the processor 36 may receive other signals (e.g., operator input) that indicate that the BOP 28 should be adjusted from the open configuration to the closed configuration (or vice versa). Then, the processor 36 may provide control signals, such as to an actuator assembly to adjust the rams to move toward one another and into the central bore to reach the closed configuration. The processor 36 may also provide control signals, such as to one or more motors (e.g., hydraulic motors, pneumatic motors, electric motors) of the one or more remote locking assemblies 30 to drive adjustment of one or more locking mechanisms (e.g., lock screws) to lock the rams in the closed configuration.

The controller 34 may be part of or include a distributed controller or control system with one or more electronic controllers in communication with one another to carry out the various techniques disclosed herein. For example, the controller 34 may be part of a distributed controller with one controller (not shown) at the vessel or platform 12 and another controller 34 at the BOP 28 and/or at the remote locking assembly 30. The processor 36 may also include one or more processors configured to execute software, such as software for processing signals and/or controlling other components associated with the BOP 28 and/or the remote locking system 32.

The memory device 38 disclosed herein may include one or more memory devices (e.g., a volatile memory, such as random access memory (RAM), and/or a nonvolatile memory, such as read-only memory (ROM)) that may store a variety of information and may be used for various purposes. For example, the memory device 38 may store processor-executable instructions (e.g., firmware or software) for the processor 36 to execute, such as instructions for processing signals and/or controlling the other components associated with the BOP 28 and/or the remote locking system 32. The controller 34 may include various other components, such as a communication device 40 that is capable of communicating data or other information to various other devices via a wired and/or a wireless connection.

The remote locking system 32 having the controller 34 enables the one or more remote locking assemblies 30 to be efficiently and remotely locked via electronic control (e.g., without a human operator, a remotely-operated vehicle (ROV), or an autonomously-operated vehicle (AUV) physically contacting and manipulating the BOP 28 or the remote locking assemblies 30. The remote locking system 32 herein also enables smooth and/or continuous application of torque to a locking mechanism 70 (discussed below) during an unlocking operation and a locking operation, as opposed to some types of manual operation that may not enable smooth and/or continuous application of torque. Additionally, the remote locking system 32 may provide a visual indicator (e.g., visible to a human operator, a ROV, or an AUV) of a configuration of the one or more remote locking assemblies 30, such as due to respective positions of each of the one or more locking assemblies 30 relative to components of the BOP 28 (e.g., because visible portions of the one or more locking assemblies 30 move relative to components of the BOP 28 during the unlocking operation and the locking operation). The remote locking system 32 may remain coupled to the BOP 28 during operations (e.g., drilling operations) and/or may be a stand-alone component that is supported by the BOP 28 (e.g., not part of an ROV or an AUV).

Figure 2:
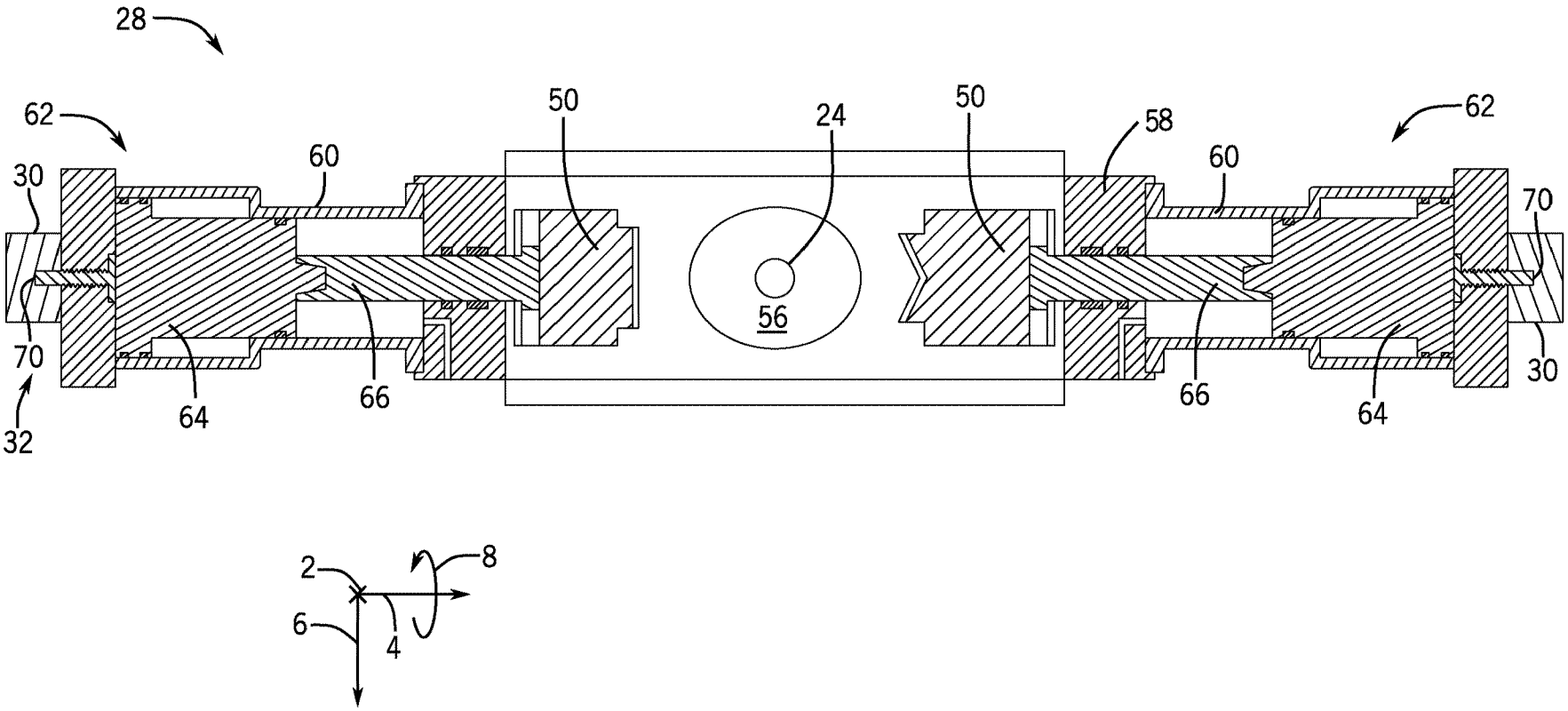
FIG. 2 illustrates is a cross-sectional top view of a portion of the BOP and the remote locking system of FIG. 1, according to an embodiment.

FIG. 2 illustrates a cross-sectional top view of a portion of one BOP 28 with two opposing rams 50 in the open configuration, according to an embodiment. In the open configuration, the rams 50 are withdrawn from a central bore 56 of the BOP 28, do not contact the conduit 24, and/or do not contact the corresponding opposing ram 50. As shown, the BOP 28 includes a housing (also referred to as a body) 58 that surrounds and defines the central bore 56. As shown, bonnets 60 are mounted to the housing 58 (e.g., via threaded fasteners). Each bonnet 60 supports an actuator 62, which includes a piston 64 and a connecting rod 66. The actuators 62 may drive the rams 50 toward and away from one another along the axial axis 4 and through the central bore 56 to shear the conduit 24 and/or to seal the central bore 56 (e.g., the annular space around the conduit 24).

As shown, a respective remote locking assembly 30 is supported by and/or coupled to each bonnet 60. Each remote locking assembly 30 is configured to actuate (e.g., via hydraulic actuation) between the unlocked configuration and the locked configuration. In the unlocked configuration, the remote locking assembly 30 allows movement of the rams 50 of the BOP 28. Thus, in the unlocked configuration, the BOP 28 may actuate between the open configuration and the closed configuration. In the locked configuration, the remote locking assembly 30 prevents movement of the rams 50 of the BOP 28. Thus, in the locked configuration, the remote locking assembly 30 may secure/lock the BOP 28 in the closed configuration.

Each remote locking assembly 30 includes or is configured to drive a locking mechanism 70 (e.g., a lock screw) that is configured to move relative to the rams 50, the central bore 56, and/or the bonnet 60. In the illustrated embodiment, the locking mechanism 70 is threadably coupled to the bonnet 60 such that rotation of the locking mechanism 70 drives the locking mechanism 70 to move along the axial axis 4 relative to the bonnet 60 (e.g., to the right and left in FIG. 2). For example, the locking mechanism 70 may be rotated in a first direction (e.g., along the circumferential axis 8) to drive the locking mechanism 70 toward the ram 50 and toward the central bore 56 while the ram 50 is in the closed configuration to thereby contact a tail rod of the piston 64 and to lock the ram 50 in the closed configuration. The locking mechanism 70 may be rotated in a second direction (e.g., opposite the first direction along the circumferential axis 8) to drive the locking mechanism 70 away the ram 50 and away the central bore 56 to thereby allow the ram 50 to be actuated from the closed configuration to the open configuration. As shown, a central or rotational axis of the locking mechanism 70 extends along the axial axis 4.

Figure 3:
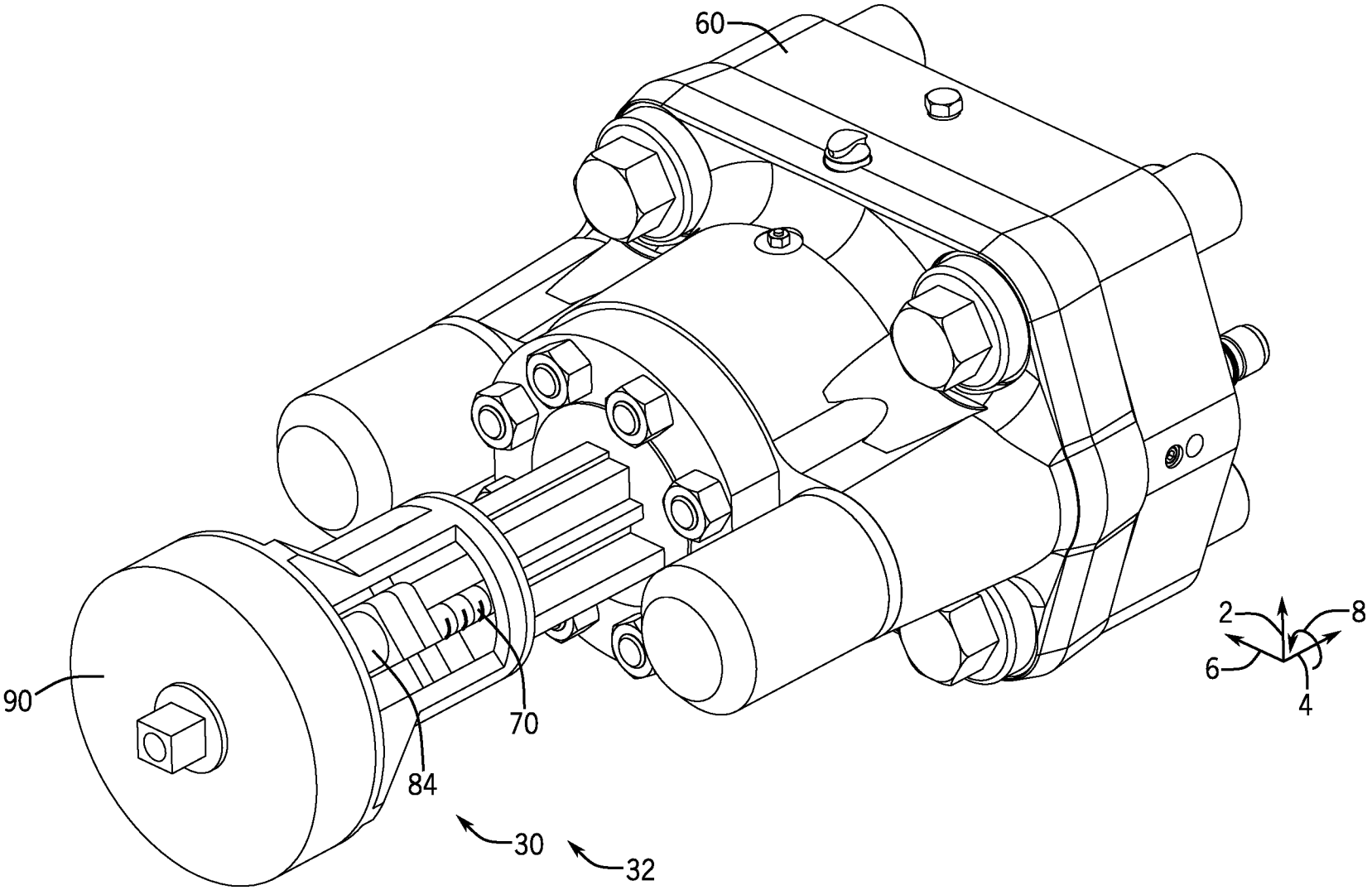
FIG. 3 illustrates a perspective view of a bonnet and a remote locking assembly that may be part of the remote locking system of FIG. 1, according to an embodiment. The remote locking assembly is in an unlocked position.
Figure 4:
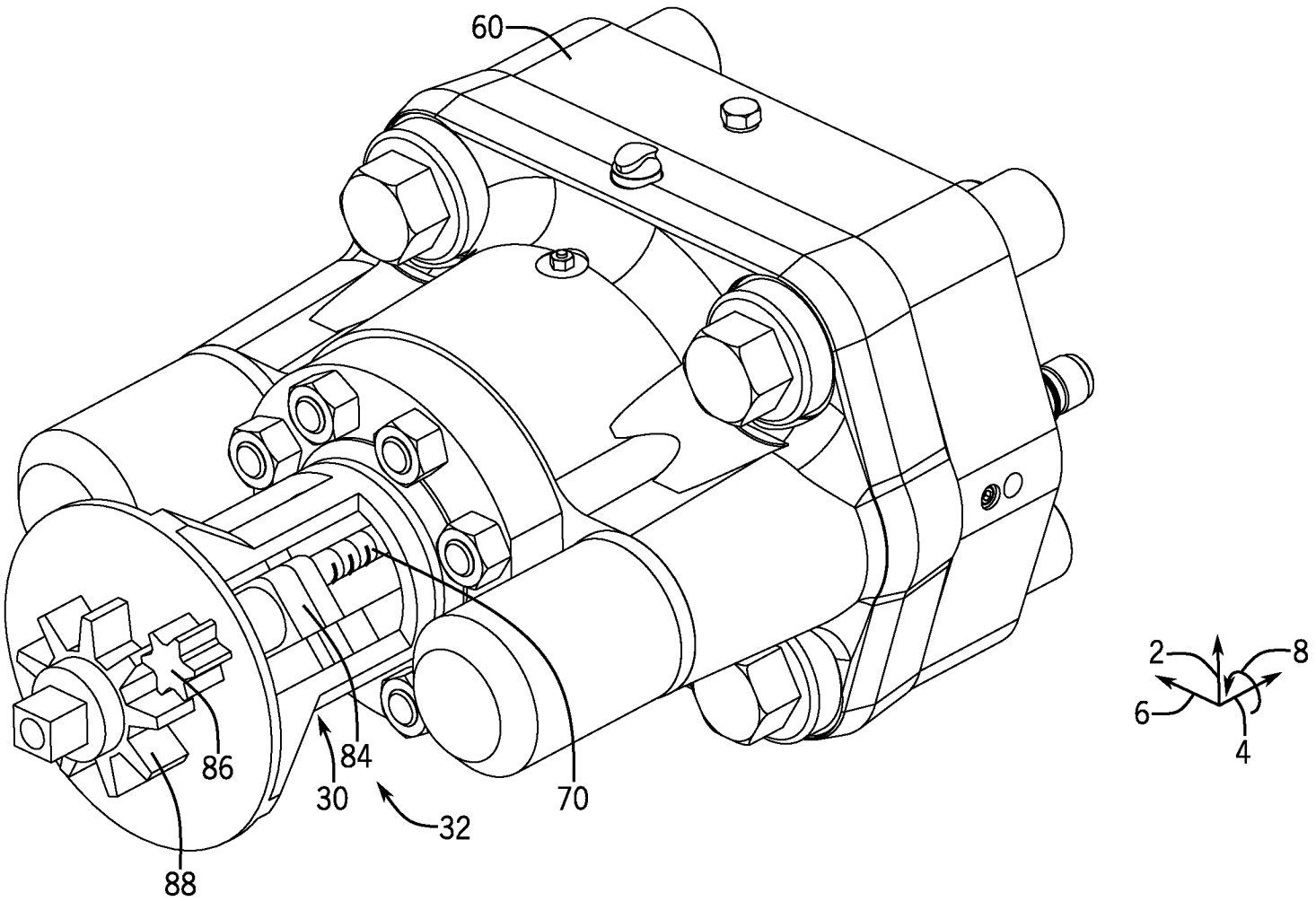
FIG. 4 illustrates a perspective view of the bonnet and the remote locking assembly of FIG. 3, according to an embodiment. The remote locking assembly is in a locked position.

FIG. 3 illustrates a perspective view of one of the bonnets 60 and one of the remote locking assemblies 30, according to an embodiment. The remote locking assembly 30 is in the unlocked configuration in FIG. 3. FIG. 4 illustrates perspective view of the bonnet 60 and the remote locking assembly 30 of FIG. 3 but with a gear housing 90 thereof omitted for the sake of illustration, according to an embodiment. The remote locking assembly 30 is in the locked configuration in FIG. 4.

The remote locking assembly 30 includes a motor 84 (e.g., hydraulic motor, pneumatic motor, electric motor) that is coupled to and drives the rotation of the locking mechanism 70 (e.g., via a gear assembly having one or more gears). In particular, the motor 84 may be coupled (e.g., directly and/or non-rotatably) to a first gear 86 (e.g., spur gear) of the gear assembly. For example, the motor 84 may be coupled to the first gear 86 via an interface between an output shaft of the motor 84 and the first gear 86. The interface may include teeth on the output shaft of the motor 84 and corresponding teeth on the first gear 86, as described below.

The first gear 86 may engage a second gear 88 (e.g., spur gear) of the gear assembly. As shown, the first gear 86 and the second gear 88 are engaged via contact between respective teeth of the first gear 86 and the second gear 88. In another embodiment, the first gear 86 and the second gear 88 may not be in direct contact with one another, and a belt may be wrapped at least partially around the gears 86, 88 to transfer the torque from the first gear 86 to the second gear 88. The first and second gears 86, 88 may be positioned at least partially within a gear housing 90.

The locking mechanism 70 may be coupled to the second gear 88 of the gear assembly. Thus, activation of the motor 84 (e.g., via application of hydraulic pressure in the case of a hydraulic motor) drives rotation of the output shaft of the motor 84, which drives rotation of the first gear 86, which drives rotation of the second gear 88, which drives rotation of the locking mechanism 70. The first gear 86 may have a first diameter, the second gear 88 may have a second diameter, and the first diameter may be different (e.g., less) than the second diameter. This may increase torque applied to the locking mechanism 70. It should be appreciated that any of a variety of combinations of gears or similar components may be utilized to transfer torque from the motor 84 to the locking mechanism 70.

As noted above, the rotation of the locking mechanism 70 drives the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56, which actuates the locking mechanism 70 from the unlocked configuration to the locked configuration. Similarly, the rotation of the locking mechanism 70 in a second direction (e.g., opposite the first direction) along the circumferential axis 8 may drive the locking mechanism 70 along the axial axis 4 away from the central bore 56, which actuates the locking mechanism 70 from the locked configuration to the unlocked configuration. As shown, the remote locking assembly 30 (e.g., the motor 84, the gear assembly) may move with the locking mechanism 70 along the axial axis 4 relative to the bonnet 60. A central or rotational axis of the output shaft of the motor 84 may be parallel to a central or rotational axis of the locking mechanism 70.

Figure 5:
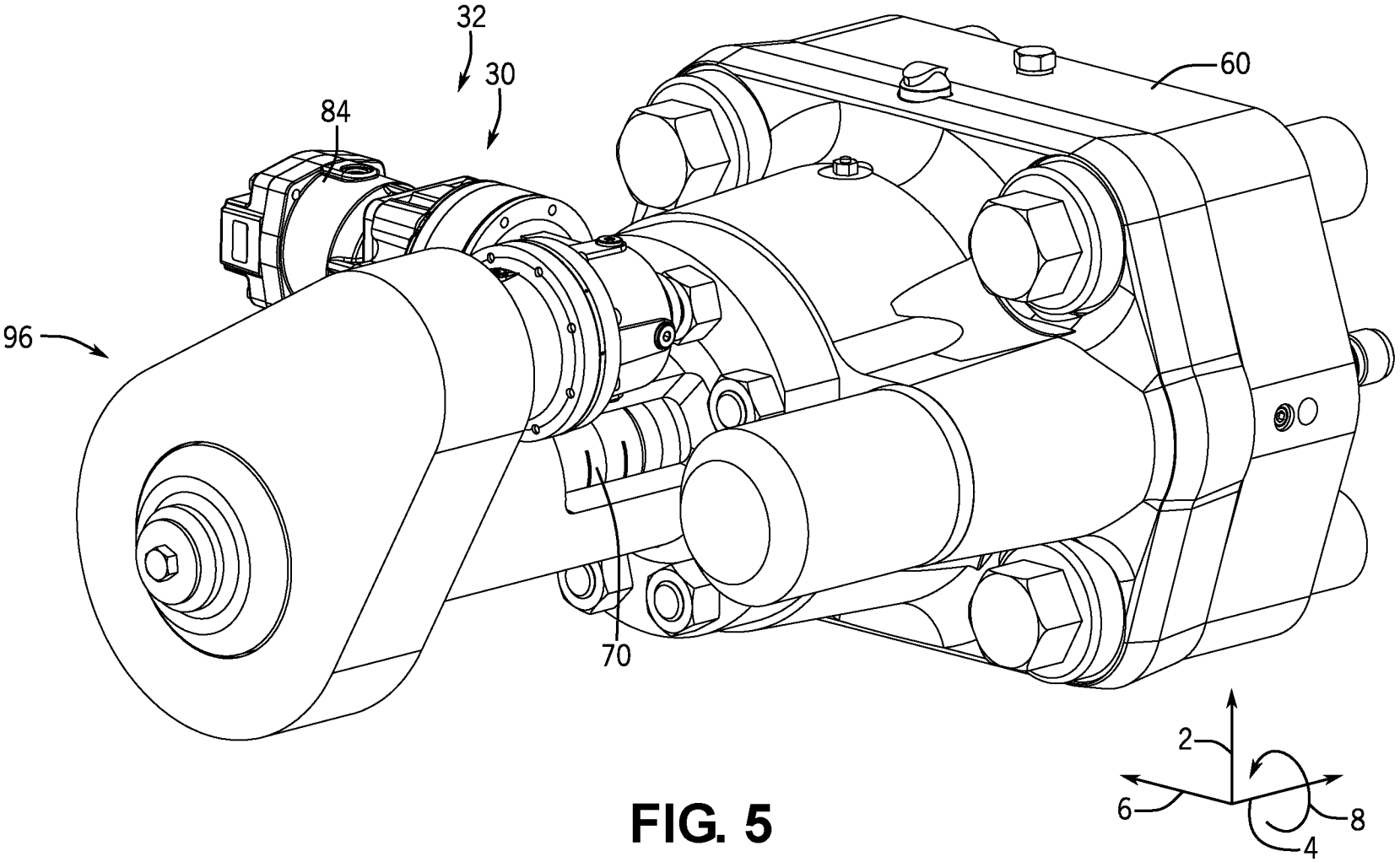
FIG. 5 illustrates a perspective view of another bonnet and remote locking assembly that may be part of the remote locking system of FIG. 1, according to an embodiment.
Figure 6:
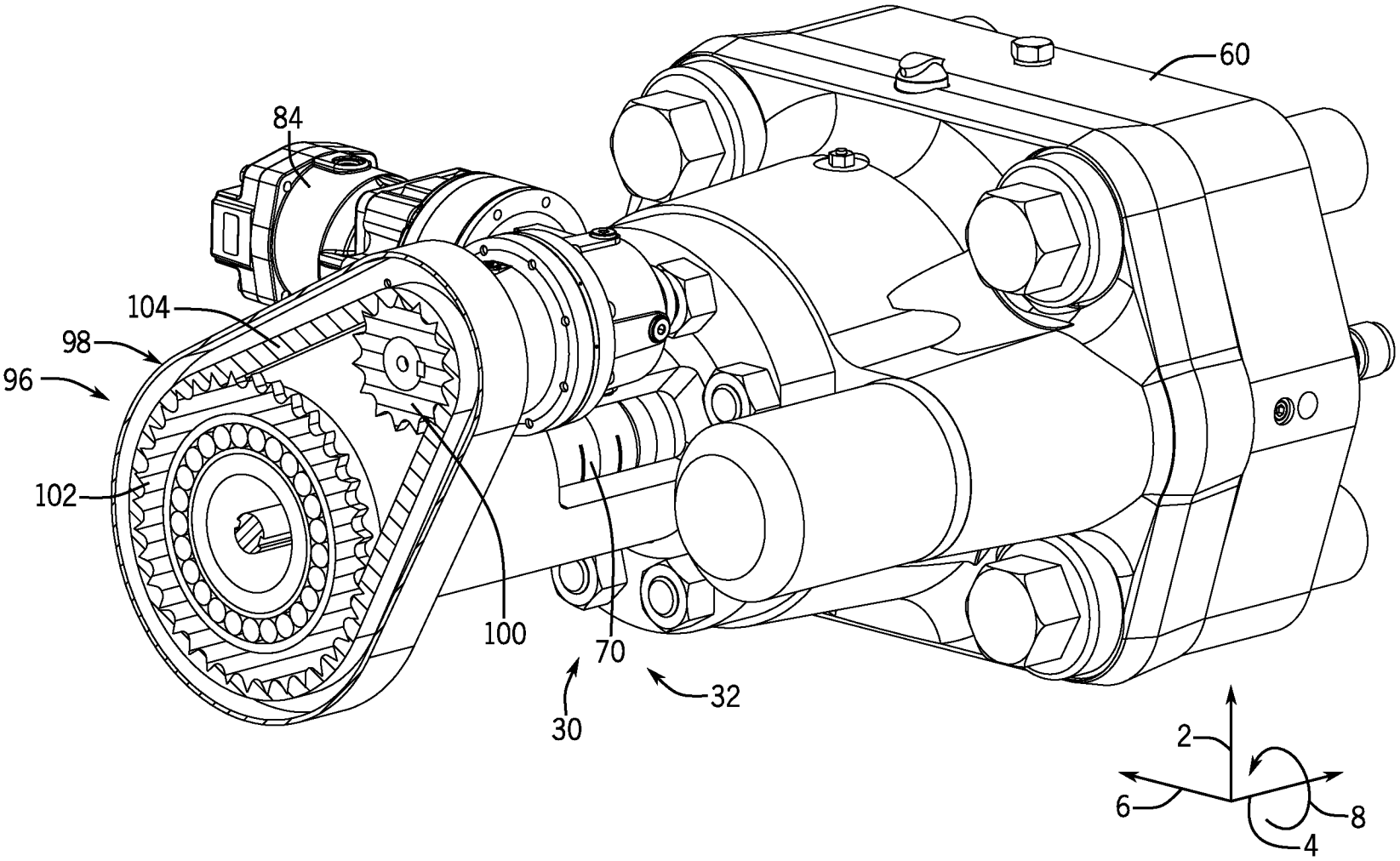
FIG. 6 illustrates a perspective view of the bonnet and the remote locking assembly of FIG. 5, according to an embodiment.
Figure 7:
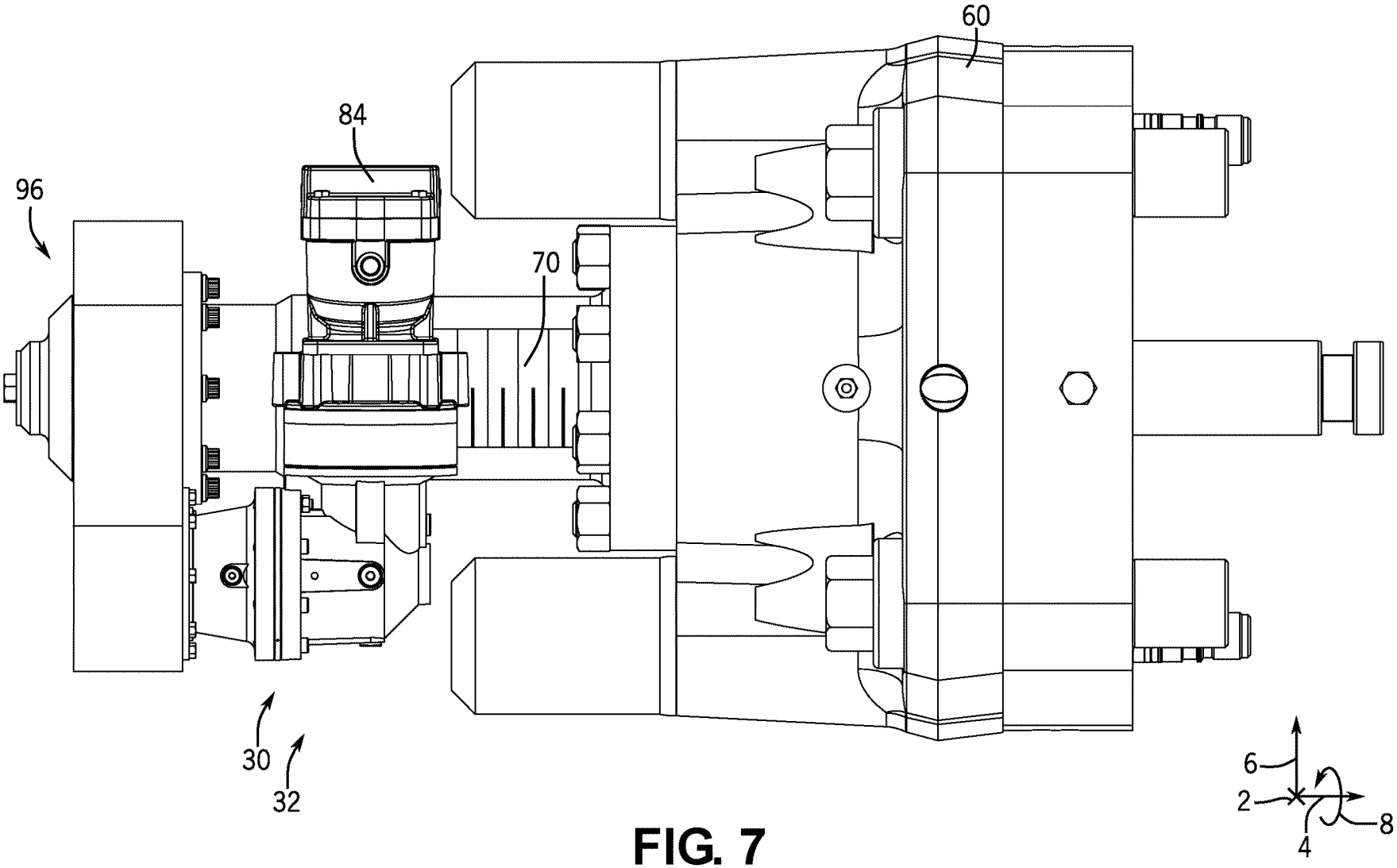
FIG. 7 illustrates a top view of the bonnet and the remote locking assembly of FIG. 5, according to an embodiment.
Figure 8:
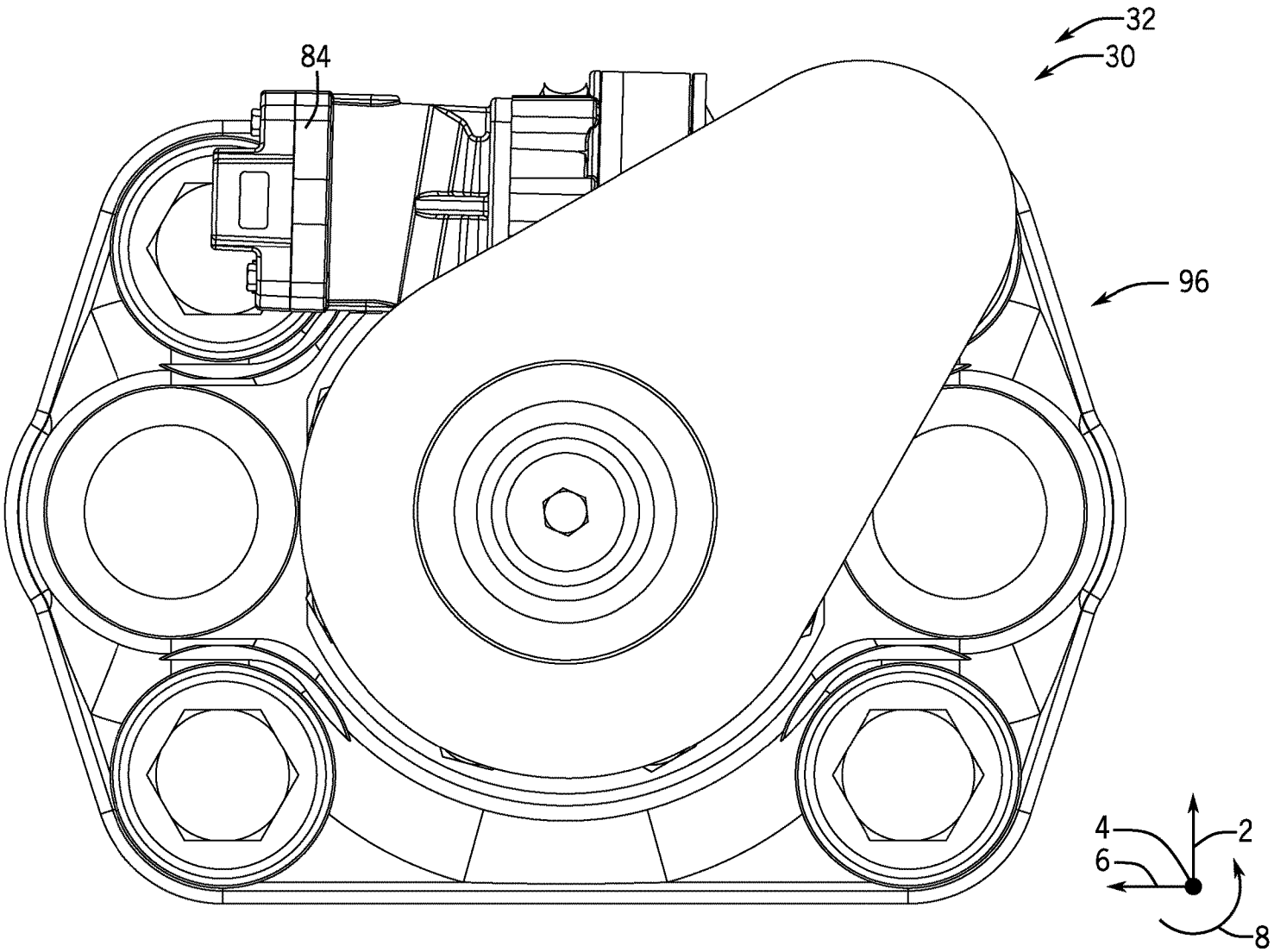
FIG. 8 illustrates an end view of the bonnet and the remote locking assembly of FIG. 5, according to an embodiment.

FIGS. 5-8 illustrate a different embodiment of the bonnet 60 and the remote locking assembly 30. More particularly, FIG. 5 illustrates a perspective view of the bonnet 60 and the remote locking assembly 30, according to an embodiment. FIG. 6 illustrates a perspective view of the bonnet and the remote locking assembly of FIG. 5, according to an embodiment. A portion of a gear housing 96 is removed to illustrate a portion of a gear assembly 98 of the remote locking assembly 30 in FIG. 6. FIG. 7 illustrates a top view of the bonnet 60 and the remote locking assembly 30 of FIG. 5, according to an embodiment. FIG. 8 illustrates an end view of the bonnet 60 and the remote locking assembly 30 of FIG. 5, according to an embodiment.

As shown, the remote locking assembly 30 includes the motor 84 (e.g., hydraulic motor, pneumatic motor, electric motor) that is coupled to and drives the rotation of the locking mechanism 70 (e.g., via the gear assembly 98). The gear assembly 98 may include one or more gears (two are shown: 100, 102) and one or more belts (one is shown: 104). In particular, as shown in FIG. 6, the motor 84 may be coupled (e.g., indirectly, non-rotatably via one or more gears) to a first gear 100 (e.g., spur gear) of the gear assembly 98. The first gear 100 may drive a second gear 102 (e.g., spur gear) of the gear assembly 98 via the belt 104, which contacts and engages respective teeth of the first gear 100 and the second gear 102.

The locking mechanism 70 may be coupled to the second gear 102 of the gear assembly. Thus, activation of the motor 84 (e.g., via application of hydraulic pressure in the case of a hydraulic motor) drives rotation of the output shaft of the motor 84, which drives rotation of the first gear 100, which drives rotation of the second gear 102, which drives rotation of the locking mechanism 70. The first gear 100 may have a first diameter, the second gear 102 may have a second diameter, and the first diameter may be different (e.g., less) than the second diameter. This may increase torque applied to the locking mechanism 70. It should be appreciated that any of a variety of combinations of gears or similar components may be utilized to transfer torque from the motor 84 to the locking mechanism 70.

As noted above, the rotation of the locking mechanism 70 drives the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56, which actuates the locking mechanism 70 from the unlocked configuration to the locked configuration. Similarly, the rotation of the locking mechanism 70 in a second direction along the circumferential axis 8 may drive the locking mechanism 70 along the axial axis 4 away from the central bore 56, which actuates the locking mechanism 70 from the locked configuration to the unlocked configuration.

In the embodiments described above, the output shaft of the motor 84 may rotate in a first direction (e.g., clockwise) to cause the locking mechanism 70 to actuate from the unlocked configuration to the locked configuration. This may be in response to a first pressure in the motor 84 (e.g., in the case of a hydraulic motor). The output shaft of the motor 84 may rotate in a second direction (e.g., counter-clockwise) to cause the locking mechanism 70 to actuate from the locked configuration to the unlocked configuration. This may be in response to a second pressure in the motor 84 (e.g., in the case of a hydraulic motor). The first and second pressures may be different. In one example, the first pressure may be 10 MPa, and the second pressure may be 14 MPa.

The embodiments described below are able to actuate the locking mechanism 70 between the locked configuration and the unlocked configuration using substantially the same pressure. For example, the embodiments described below may generate different torques (e.g., by causing the locking mechanism 70 to rotate in different directions) using substantially the same pressure.

Figure 9:
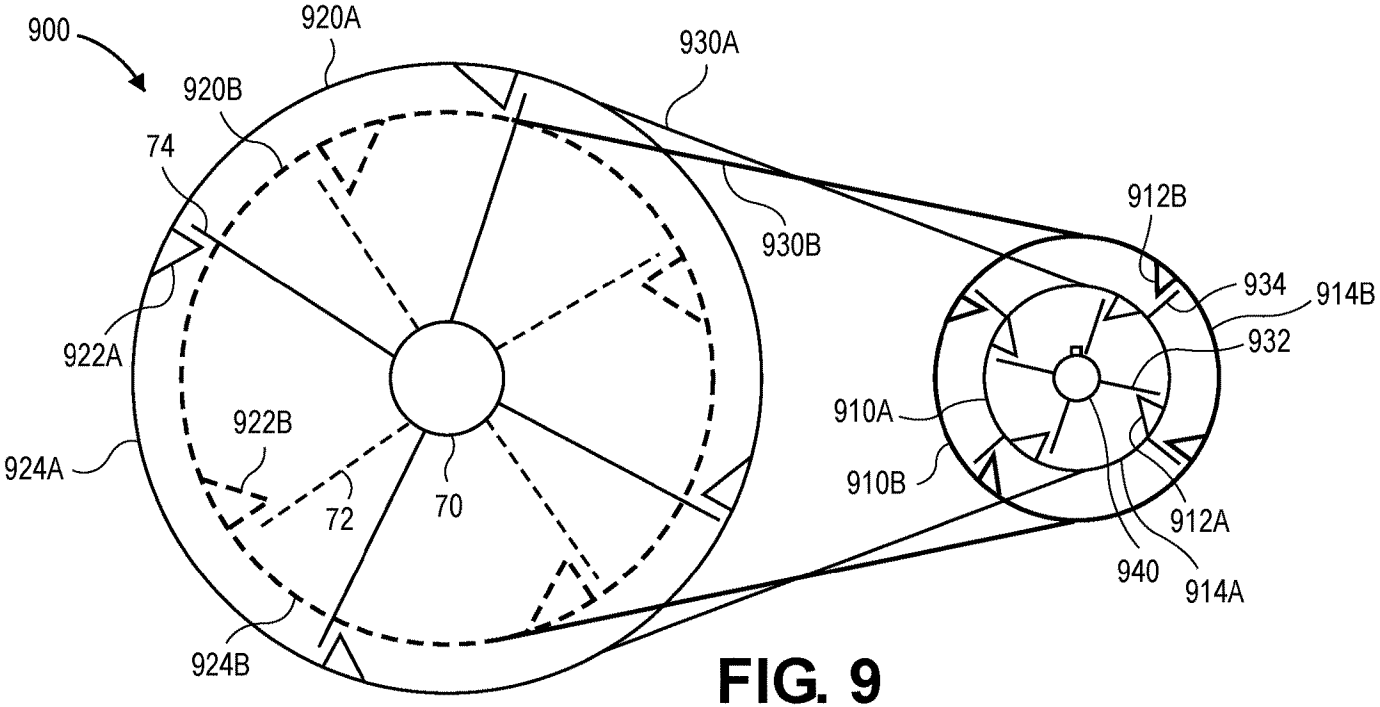
FIG. 9 illustrates a schematic side view of a gear assembly of the remote locking assembly, according to an embodiment.
Figure 10:
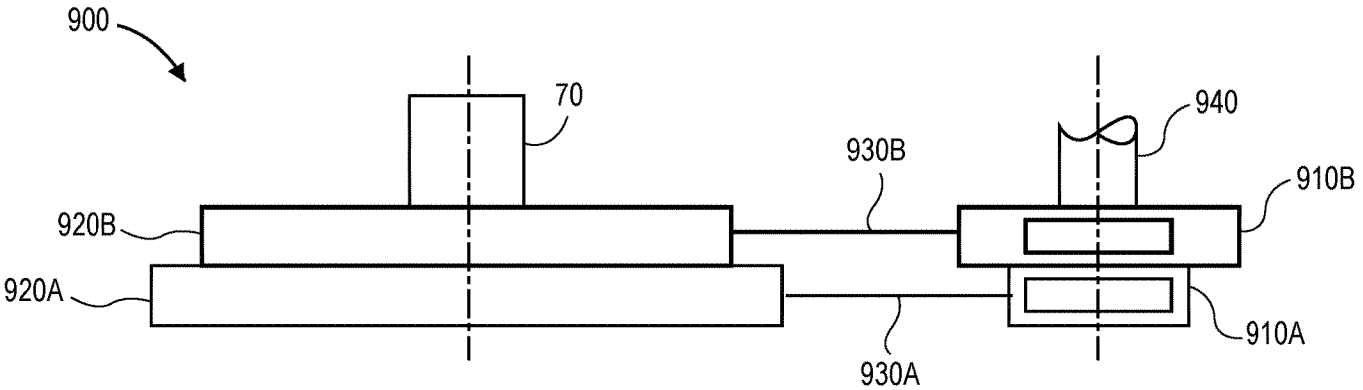
FIG. 10 illustrates a schematic top view of the gear assembly shown in FIG. 9, according to an embodiment.

FIG. 9 illustrates a schematic side view of another gear assembly 900 including a first set of gears 910A, 920A and a second set of gears 910B, 920B, according to an embodiment. FIG. 10 illustrates a schematic top view of the gear assembly 900 shown in FIG. 9, according to an embodiment. The gear 920B is shown in dashed lines in FIG. 9, as it is behind the larger gear 920A.

The gear assembly 900 may be used as an alternative to the gears 86, 88 in the gear assembly of FIG. 3, or as an alternative to the gears 100, 102 in the gear assembly 98 of FIG. 6. For example, the first set of gears 910A, 920A and the second set of gears 910B, 920B may both be positioned at least partially within the gear housing 90 (see FIG. 3), the gear housing 96 (see FIG. 5-8), or another gear housing.

As described in greater detail below, the gears 910A, 910B may be coupled to and/or engaged with a shaft 940 of the motor 84 (i.e., the motor shaft), and the gears 920A, 920B may be coupled to and/or engaged with the locking mechanism 70. The gears 910A, 910B may be coaxial with one another (and the motor shaft 940), and axially offset from one another along the motor shaft 940. The gears 920A, 920B may be coaxial with one another (and the locking mechanism 70), and axially offset from one another along the locking mechanism 70. The motor shaft 940 may be parallel with the locking mechanism 70.

As shown, the gear 910A has a different (e.g., smaller) diameter than the gear 910B. Thus, the gear 910A may be referred to as the smaller motor gear, and the gear 910B may be referred to as the larger motor gear. Similarly, the gear 920A may have a different (e.g., larger) diameter than the gear 920B. Thus, the gear 920A may be referred to as the larger lock gear, and the gear 920B may be referred to as the smaller lock gear.

The motor gears 910A, 910B may each include teeth 912A and 912B, respectively. The teeth 912A may extend radially inward from an outer ring 914A of the smaller motor gear 910A, and the teeth 912B may extend radially inward from an outer ring 914B of the larger motor gear 910B. The teeth 912A may be axially offset from the teeth 912B with respect to the motor shaft 940. In one embodiment, the teeth 912A, 912B may be or include splines.

The motor shaft 940 may include teeth 932 that are aligned with and configured to engage the teeth 912A on the smaller motor gear 910A. The motor shaft 940 may also include teeth 934 that are aligned with and configured to engage the teeth 912B on the larger motor gear 910B. The teeth 932, 934 may extend radially outward from the motor shaft 940. The teeth 932 may be axially offset from the teeth 934 along the motor shaft 940. In one embodiment, the teeth 932, 934 may be or include splines.

The teeth 932 may be positioned radially inward from the teeth 934. Similarly, the teeth 912A may be positioned radially inward from the teeth 912B. The number of teeth 912A on the smaller motor gear 910A may be less than the number of the teeth 912B on the larger motor gear 910B. In one example, the smaller motor gear 910A may have nineteen teeth 912A, and the larger motor gear 910B may have twenty-four teeth 912B.

The teeth 912A and/or the teeth 932 may be configured to engage with one another to transfer torque from the motor shaft 940 to the smaller motor gear 910A when the motor shaft 940 rotates in a first (e.g., clockwise) direction. For example, when the motor 84 rotates the motor shaft 940 in the clockwise direction, the teeth 912A, 932 engage one another and cause the smaller motor gear 910A to also rotate in the clockwise direction.

The teeth 912A and/or the teeth 932 may be configured to not engage one another when the motor shaft 940 rotates in a second (e.g., counter-clockwise) direction such that no torque is transferred from the motor shaft 940 to the smaller motor gear 910A. For example, when the motor 84 rotates the motor shaft 940 in the counter-clockwise direction, the teeth 912A of the smaller motor gear 910A may become disengaged (e.g., axially and/or radially misaligned) with teeth 932 of the motor shaft 940. As a result, the smaller motor gear 910A may be in a freewheel state when the motor shaft 940 rotates in the counter-clockwise direction. Thus, when the motor shaft 940 rotates in the counter-clockwise direction, the smaller motor gear 910A may either not be rotating, or the smaller motor gear 910A may rotate in the clockwise direction.

The teeth 912B and/or the teeth 934 may be configured to engage with one another to transfer torque from the motor shaft 940 to the larger motor gear 910B when the motor shaft 940 rotates in the second (e.g., counter-clockwise) direction. For example, when the motor 84 rotates the motor shaft 940 in the counter-clockwise direction, the teeth 912B, 934 engage one another and cause the larger motor gear 910B to also rotate in the counter-clockwise direction.

The teeth 912B and/or the teeth 934 may be configured to not engage one another when the motor shaft 940 rotates in the first (e.g., clockwise) direction such that no torque is transferred from the motor shaft 940 to the larger motor gear 910B. For example, when the motor 84 rotates the motor shaft 940 in the clockwise direction, the teeth 912B of the larger motor gear 910B may become axially and/or radially misaligned with the teeth 934 of the motor shaft 940. As a result, the larger motor gear 910B may be in a freewheel state when the motor shaft 940 rotates in the clockwise direction. Thus, when the motor shaft 940 rotates in the clockwise direction, the larger motor gear 910B may either not be rotating, or the larger motor gear 910B may rotate in the counter-clockwise direction.

The motor gears 910A, 910B may be configured to transfer their rotary motion/torque to the lock gears 920A, 920B, respectively. Although not shown, in one embodiment, the motor gears 910A, 910B may be configured to transfer their rotary motion/torque to the lock gears 920A, 920B, respectively, via direct contact, as is done between the gears 86, 88 in FIG. 4. However, in the embodiment shown in FIGS. 9 and 10, a first belt 930A may be wrapped at least partially around the first set of gears 910A, 920A and configured to transfer the rotary motion/torque from the smaller motor gear 910A to the larger lock gear 920A. Similarly, a second belt 930B may be wrapped at least partially around the second set of gears 910B, 920B and configured to transfer the rotary motion/torque from the larger motor gear 910B to the smaller lock gear 920B.

As discussed above, the lock gears 920A, 920B may be coupled to and/or engaged with the locking mechanism 70.

The lock gears 920A, 920B may each include teeth 922A and 922B, respectively. The teeth 922A may extend radially inward from an outer ring 924A of the larger lock gear 920A, and the teeth 922B may extend radially inward from an outer ring 924B of the smaller lock gear 920B. The teeth 922A may be axially offset from the teeth 922B with respect to the locking mechanism 70. In one embodiment, the teeth 922A, 922B may be or include splines.

The locking mechanism 70 may include teeth 74 that are aligned with and configured to engage the teeth 922A on the larger lock gear 920A. The locking mechanism 70 may also include teeth 72 that are aligned with and configured to engage the teeth 922B on the smaller lock gear 920B. The teeth 72, 74 may extend radially outward from the locking mechanism 70. The teeth 72 may be axially offset from the teeth 74 along the locking mechanism 70. In one embodiment, the teeth 72, 74 may be or include splines.

The teeth 72 may be positioned radially inward from the teeth 74. Similarly, the teeth 922B may be positioned radially inward from the teeth 922A. The number of teeth 922A on the larger lock gear 920A may be greater than the number of the teeth 922B on the smaller lock gear 920B. In one example, the larger lock gear 920A may have thirty-nine teeth 922A, and the smaller lock gear 920B may have thirty-six teeth 922B.

The teeth 922A and/or the teeth 74 may be configured to engage with one another to transfer torque from the larger lock gear 920A to the locking mechanism 70 when the larger lock gear 920A rotates in the first (e.g., clockwise) direction. For example, when the larger lock gear 920A rotates in the clockwise direction, the teeth 922A, 74 engage one another and cause the locking mechanism 70 to also rotate in the clockwise direction. As discussed above, this may cause the locking mechanism 70 to actuate from the unlocked configuration to the locked configuration.

The teeth 922A and/or the teeth 74 may be configured to not engage one another when the larger lock gear 920A rotates in the second (e.g., counter-clockwise) direction such that no torque is transferred from the larger lock gear 920A to the locking mechanism 70. For example, when the larger lock gear 920A rotates in the counter-clockwise direction, the teeth 922A of the larger lock gear 920A may become axially and/or radially misaligned with the teeth 74 of the locking mechanism 70. As a result, the larger lock gear 920A may be in a freewheel state when rotating in the counter-clockwise direction. Thus, when the larger lock gear 920 rotates in the counter-clockwise direction, the locking mechanism 70 may either not be rotating, or the locking mechanism 70 may rotate in the clockwise direction.

The teeth 922B and/or the teeth 72 may be configured to engage with one another to transfer torque from the smaller lock gear 920B to the locking mechanism 70 when the smaller lock gear 920B rotates in the second (e.g., counter-clockwise) direction. For example, when the smaller lock gear 920B rotates in the counter-clockwise direction, the teeth 922B, 72 engage one another and cause the locking mechanism 70 to also rotate in the counter-clockwise direction. As discussed above, this may cause the locking mechanism 70 to actuate from the locked configuration to the unlocked configuration.

The teeth 922B and/or the teeth 72 may be configured to not engage one another when the smaller lock gear 920B rotates in the first (e.g., clockwise) direction such that no torque is transferred from the smaller lock gear 920*b* to the locking mechanism 70. For example, when the smaller lock gear 920B rotates in the clockwise direction, the teeth 922B of the smaller lock gear 920B may become axially and/or radially misaligned with the teeth 72 of the locking mechanism 70. As a result, the smaller lock gear 920B may be in a freewheel state when rotating in the clockwise direction. Thus, when the smaller lock gear 920B rotates in the clockwise direction, the locking mechanism 70 may either not be rotating, or the locking mechanism 70 may rotate in the counter-clockwise direction.

In the embodiments in FIGS. 9 and 10, the output shaft 940 of the motor 84 may rotate in a first direction (e.g., clockwise) to cause the locking mechanism 70 to actuate from the unlocked configuration to the locked configuration. The output shaft 940 of the motor 84 may rotate in a second direction (e.g., counter-clockwise) to cause the locking mechanism 70 to actuate from the locked configuration to the unlocked configuration. Both actuations may be in response to substantially the same pressure in the motor 84 (e.g., in the case of a hydraulic motor).

Performing both actuations at substantially the same pressure may be achieved by using the gear assembly 900 including the two sets of gears 910A, 920A and 910B, 920B. More particularly, performing both actuations at substantially the same pressure may be based at least partially upon the sizes (e.g., diameters) of the gears 910A, 910B, 920A, 920B (i.e., the gear ratios), the number of teeth 912A, 912B, 922A, 922B on the gears 910A, 910B, 920A, 920B, the speed/torque relationship between the gears 910A, 910B, 920A, 920B, or a combination thereof.

In one example, the pressure to perform both actuations may be substantially the same (e.g., about 10 MPa). As used herein, "substantially the same pressure" refers to within about 2 MPa, within 1 MPa, within 500 kPa, or within 100 kPa. Actuating the locking mechanism 70 from the unlocked configuration to the locked configuration, and from the locked configuration to the unlocked configuration, using substantially the same pressure may provide the benefit of simplifying/reducing the equipment used to run and/or monitor the motor 84. More particularly, the motor 84 has many components and operations that work together to generate a predetermined pressure. If one or more of these components or operations malfunctions, the predetermine pressure may not be generated. The systems (e.g., mechanical systems) and methods disclosed herein simplify the components and operations so that the predetermined pressure can be generated.

Figure 11:
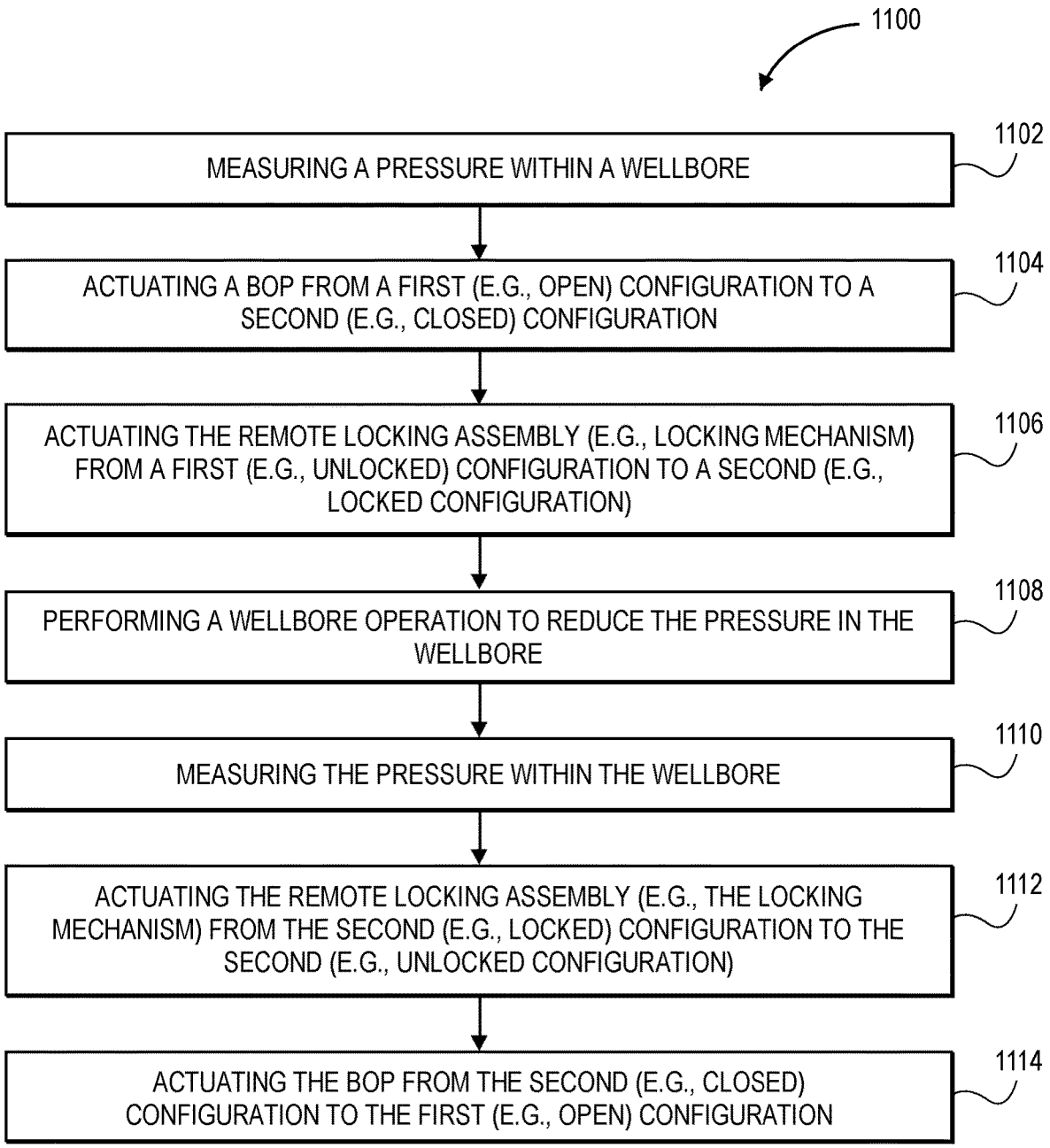
FIG. 11 illustrates a flowchart of a method for operating the BOP, according to an embodiment.

FIG. 11 illustrates a flowchart of a method 1100 for operating the BOP 28, according to an embodiment. An illustrative order of the method 1100 is provided below. However, it will be appreciated that one or more portions of the method 1100 may be performed in a different order, performed simultaneously, repeated, or omitted. In addition, although the method 1100 is described as actuating the BOP 28 from a first (e.g., open) configuration to a second (e.g., closed) configuration, and/or actuating the remote locking assembly 30 from a first (e.g., unlocked) configuration to a second (e.g., locked) configuration, the method 1100 may also or instead be used to actuate any device from a first configuration to a second configuration.

The method 1100 may include measuring the pressure within the wellbore 26, as at 1102. In response to the measured pressure being greater than a pressure threshold, the method 1100 may also include actuating the BOP 28 from the first (e.g., open) configuration to the second (e.g., closed) configuration, as at 1104.

The method 1100 may also include actuating the remote locking assembly 30 (e.g., the locking mechanism 70) from a first (e.g., unlocked) configuration to a second (e.g., locked configuration), as at 1106. This may secure the BOP 28 in the closed configuration. Actuating the remote locking assembly 30 may include causing the motor 84 to rotate the motor shaft 940 in a first (e.g., clockwise) direction. When the motor 84 is a hydraulic motor, this may include increasing the pressure in the motor to a predetermined pressure (e.g., 10 MPa). As described above, in response to the motor shaft 940 rotating in the clockwise direction, the teeth 932 of the motor shaft 940 may engage the teeth 912A of the smaller motor gear 910A, causing the smaller motor gear 910A to rotate in the clockwise direction. This may cause the first belt 930A to rotate in the clockwise direction, which may cause the larger lock gear 920A to rotate in the clockwise direction. In response to the larger lock gear 920A rotating in the clockwise direction, the teeth 922A of the larger lock gear 920A may engage the teeth 74 of the locking mechanism 70, causing the locking mechanism 70 to rotate in the clockwise direction. This causes the locking mechanism 70 to move axially in the first direction, which actuates the locking mechanism 70 into the locked configuration.

As discussed above, when the motor shaft 940, the smaller motor gear 910A, the first belt 930A, the larger lock gear 920A, the locking mechanism 70, or a combination thereof is/are rotating in the clockwise direction, the larger motor gear 910B and/or the smaller lock gear 920B may be in a freewheel state in which they may not be rotating, or they may be rotating in the counter-clockwise direction.

The method 1100 may also include performing a wellbore operation to reduce the pressure in the wellbore 26, as at 1108. In one example, the wellbore operation may include reducing the flow rate of the fluid being pumped into the wellbore 26, reducing the weight-on-bit (WOB), or the like.

The method 1100 may also include measuring the pressure within the wellbore 26, as at 1110. In one embodiment, the pressure may be measured after the wellbore operation.

In response to the measured pressure (now) being less than the pressure threshold (e.g., after the wellbore operation), the method 1100 may include actuating the remote locking assembly 30 (e.g., the locking mechanism 70) from the second (e.g., locked) configuration to the second (e.g., unlocked configuration), as at 1112. This may allow the BOP 28 to be actuated into the open configuration, as discussed below. Actuating the remote locking assembly 30 may include causing the motor 84 to rotate the motor shaft 940 in the second (e.g., counter-clockwise) direction. When the motor 84 is a hydraulic motor, this may include increasing the pressure in the motor to the predetermined pressure (e.g., 10 MPa). As described above, in response to the motor shaft 940 rotating in the counter-clockwise direction, the teeth 934 of the motor shaft 940 may engage the teeth 912B of the larger motor gear 910A, causing the larger motor gear 910B to rotate in the counter-clockwise direction. This may cause the second belt 930B to rotate in the counter-clockwise direction, which may cause the smaller lock gear 920B to rotate in the counter-clockwise direction. In response to the smaller lock gear 920B rotating in the counter-clockwise direction, the teeth 922B of the smaller lock gear 920B may engage the teeth 72 of the locking mechanism 70, causing the locking mechanism to rotate in the counter-clockwise direction. This causes the locking mechanism 70 to move axially in the second direction, which actuates the locking mechanism 70 into the unlocked configuration.

As discussed above, when the motor shaft 940, the larger motor gear 910B, the second belt 930B, the smaller lock gear 920B, the locking mechanism 70, or a combination thereof is/are rotating in the counter-clockwise direction, the smaller motor gear 910A and/or the larger lock gear 920A may be in a freewheel state in which they may not be rotating, or they may be rotating in the clockwise direction.

The method 1100 may also include actuating the BOP 28 from the second (e.g., closed) configuration to the first (e.g., open) configuration, as at 1114.

Advantageously, the remote locking system disclosed herein may be utilized with a BOP, such as a BOP of an offshore system or an on-shore system. Thus, the remote locking system may be configured for use in a subsea environment and/or may have features that enable the remote locking system to be efficiently operated in a subsea environment or another remote environment even while the remote locking system is not physically accessible by an operator (e.g., manually by an operator, an ROV, and/or an AUV). For example, the remote locking assembly may be controlled via a controller in response to inputs at a remote base station (e.g., at a platform at a sea surface) that is physically separate from the remote locking assembly of the remote locking system. It should be appreciated that the remote locking system disclosed herein may be used with any of a variety of types of BOP's, including BOP's that have only a single ram (e.g., that seal the central bore with only the single ram; without an opposed ram). It should also be appreciated that any of the features disclosed above with respect to FIGS. 1-11 may be combined in any suitable manner.

As used herein, the terms "inner" and "outer"; "up" and "down"; "upper" and "lower"; "upward" and "downward"; "upstream" and "downstream"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A locking assembly, comprising:

a first motor gear configured to be rotated in a first direction in response to a motor shaft rotating in the first direction;

a second motor gear configured to be rotated in a second direction in response to the motor shaft rotating in the second direction, wherein the motor shaft rotates in the first direction and the second direction at substantially a same pressure;

a first lock gear configured to be rotated in the first direction in response to the first motor gear rotating in the first direction;

a second lock gear configured to be rotated in the second direction in response to the second motor gear rotating in the second direction; and a locking mechanism configured to be rotated in the first direction in response to the first lock gear rotating in the first direction, and to be rotated in the second direction in response to the second lock gear rotating in the second direction.

2. The locking assembly of claim 1, wherein the locking mechanism moves in a first axial direction in response to being rotated in the first direction, and wherein the locking mechanism moves in a second axial direction in response to being rotated in the second direction, and wherein the first direction and the second direction are opposite to one another.

3. The locking assembly of claim 2, wherein the locking mechanism moving in the first axial direction actuates the locking mechanism from a first configuration to a second configuration, wherein the locking mechanism moving in the second axial direction actuates the locking mechanism from the second configuration to the first configuration, wherein the locking mechanism in the first configuration allows a blowout preventer (BOP) to actuate between an open configuration and a closed configuration, and wherein the locking mechanism in the second configuration prevents the BOP from actuating between the open configuration and the closed configuration.

4. The locking assembly of claim 1, wherein the first motor gear has a smaller diameter than the second motor gear, and wherein the first lock gear has a larger diameter than the second lock gear.

5. The locking assembly of claim 1, further comprising:

a first belt wrapped at least partially around the first motor gear and the first lock gear, wherein the first belt is configured to transmit torque from the first motor gear to the first lock gear; and a second belt wrapped at least partially around the second motor gear and the second lock gear, wherein the second belt is configured to transmit torque from the second motor gear to the second lock gear, and wherein the first motor gear, the first lock gear, and the first belt are substantially parallel to the second motor gear, the second lock gear, and the second belt, respectively.

6. The locking assembly of claim 1, wherein the first motor gear, the second motor gear, and the motor shaft are coaxial with one another, wherein the first lock gear, the second lock gear, and the locking mechanism are coaxial with one another, and wherein the motor shaft is substantially parallel with the locking mechanism.

7. The locking assembly of claim 1, wherein the first motor gear is configured to be in a freewheel state when the motor shaft and the second motor gear are rotating in the second direction, and wherein the second motor gear is configured to be in a freewheel state when the motor shaft and the first motor gear are rotating in the first direction.

8. The locking assembly of claim 1, wherein the first lock gear is configured to be in a freewheel state when the second lock gear and the locking mechanism are rotating in the second direction, and wherein the second lock gear is configured to be in a freewheel state when the first lock gear and the locking mechanism are rotating in the first direction.

9. The locking assembly of claim 1, wherein the motor shaft is configured to transfer torque to the first motor gear when the motor shaft is rotating in the first direction, and wherein the motor shaft is configured to not transfer torque to the first motor gear when the motor shaft is rotating in the second direction.

10. The locking assembly of claim 1, wherein the first lock gear is configured to transfer torque to the locking mechanism when the first lock gear is rotating in the first direction, and wherein the first lock gear is configured to not transfer torque to the locking mechanism when the first lock gear is rotating in the second direction.

11. A system, comprising:

a motor comprising a motor shaft that is configured to rotate in a first direction in response to a first motor pressure, and to rotate in a second direction in response to a second motor pressure, wherein the first and second directions are opposite to one another, and wherein the first and second motor pressures are within 1 MPa of one another;

a locking assembly comprising:

a smaller motor gear configured to be rotated in the first direction in response to the motor shaft rotating in the first direction;

a larger motor gear configured to be rotated in the second direction in response to the motor shaft rotating in the second direction;

a larger lock gear configured to be rotated in the first direction in response to the smaller motor gear rotating in the first direction;

a smaller lock gear configured to be rotated in the second direction in response to the larger motor gear rotating in the second direction;

a first belt wrapped at least partially around the smaller motor gear and the larger lock gear, wherein the first belt is configured to transmit torque from the smaller motor gear to the larger lock gear;

a second belt wrapped at least partially around the larger motor gear and the smaller lock gear, wherein the second belt is configured to transmit torque from the larger motor gear to the smaller lock gear; and a locking mechanism configured to be rotated in the first direction in response to the larger lock gear rotating in the first direction, which causes the locking mechanism to move in a first axial direction and to actuate from an unlocked configuration to a locked configuration, and wherein the locking mechanism is configured to be rotated in the second direction in response to the smaller lock gear rotating in the second direction, which causes the locking mechanism to move in a second axial direction and to actuate from the locked configuration to the unlocked configuration; and a blowout preventer (BOP) configured to actuate between an open configuration and a closed configuration, wherein the locking mechanism allows the BOP to actuate between the open configuration and the closed configuration when the locking mechanism is in the unlocked configuration, and wherein the locking mechanism prevents the BOP from actuating between the open configuration and the closed configuration when the locking mechanism is in the locked configuration.

12. The system of claim 11, wherein the smaller motor gear, the larger lock gear, and the first belt are substantially parallel to the larger motor gear, the smaller lock gear, and the second belt, respectively.

13. The system of claim 12, wherein the smaller motor gear, the larger motor gear, and the motor shaft are coaxial with one another, wherein the larger lock gear, the smaller lock gear, and the locking mechanism are coaxial with one another, and wherein the motor shaft is substantially parallel with the locking mechanism.

14. The system of claim 13, wherein the smaller motor gear is configured to be in a freewheel state when the motor shaft and the larger motor gear are rotating in the second direction, wherein the larger motor gear is configured to be in a freewheel state when the motor shaft and the smaller motor gear are rotating in the first direction, wherein the larger lock gear is configured to be in a freewheel state when the smaller lock gear and the locking mechanism are rotating in the second direction, and wherein the smaller lock gear is configured to be in the freewheel state when the larger lock gear and the locking mechanism are rotating in the first direction.

15. The system of claim 11, wherein the motor shaft is configured to transfer torque to the smaller motor gear when the motor shaft is rotating in the first direction, wherein the motor shaft is configured to not transfer torque to the smaller motor gear when the motor shaft is rotating in the second direction, wherein the larger lock gear is configured to transfer torque to the locking mechanism when the larger lock gear is rotating in the first direction, and wherein the larger lock gear is configured to not transfer torque to the locking mechanism when the larger lock gear is rotating in the second direction.

16. A method for operating a blowout preventer (BOP), the method comprising:

actuating the BOP from an open configuration into a closed configuration;

actuating a locking assembly from an unlocked configuration into a locked configuration when the BOP is in the closed configuration, wherein actuating the locking assembly from the unlocked configuration into the locked configuration comprises:

causing a motor shaft to rotate in a first direction, which causes a first motor gear to rotate in the first direction, which causes a first lock gear to rotate in the first direction, which causes a locking mechanism to rotate in the first direction, which causes the locking mechanism to move in a first axial direction, which actuates the locking assembly from the unlocked configuration into the locked configuration, wherein the locking assembly prevents the BOP from actuating between the open configuration and the closed configuration when the locking assembly is in the locked configuration; and actuating the locking assembly from the locked configuration into the unlocked configuration, wherein actuating the locking assembly from the locked configuration into the unlocked configuration comprises:

causing the motor shaft to rotate in a second direction, which causes a second motor gear to rotate in the second direction, which causes a second lock gear to rotate in the second direction, which causes the locking mechanism to rotate in the second direction, which causes the locking mechanism to move in a second axial direction, which actuates the locking assembly from the locked configuration into the unlocked configuration, wherein the locking assembly allows the BOP to actuate between the open configuration and the closed configuration when the locking assembly is in the unlocked configuration, and wherein the motor shaft rotates in the first direction and the second direction at substantially a same pressure; and actuating the BOP from the closed configuration into the open configuration when the locking assembly is in the unlocked configuration.

17. The method of claim 16, further comprising:

measuring a first pressure in a wellbore at a first time, wherein the BOP is actuated from the open configuration into the closed configuration in response to the first pressure being greater than a threshold; and measuring a second pressure in the wellbore at a second time, wherein the BOP is actuated from the closed configuration into the open configuration in response to the second pressure being less than the threshold.

18. The method of claim 17, wherein the first motor gear is configured to be in a freewheel state when the motor shaft and the second motor gear are rotating in the second direction, wherein the second motor gear is configured to be in a freewheel state when the motor shaft and the first motor gear are rotating in the first direction, wherein the first lock gear is configured to be in a freewheel state when the second lock gear and the locking mechanism are rotating in the second direction, and wherein the second lock gear is configured to be in the freewheel state when the first lock gear and the locking mechanism are rotating in the first direction.

19. The method of claim 18, wherein the first motor gear, the second motor gear, and the motor shaft are coaxial with one another, wherein the first lock gear, the second lock gear, and the locking mechanism are coaxial with one another, and wherein the motor shaft is substantially parallel with the locking mechanism.

* * * * *